United States Patent [19]

Bousquet et al.

[11] 4,206,037

[45] Jun. 3, 1980

[54] CATALYTIC TREATMENT OF GAS OILS

[75] Inventors: Jacques Bousquet, Irigny; Jean-René Bernard, Serezin du Rhone, both of France

[73] Assignee: Elf Union, Paris, France

[21] Appl. No.: 953,784

[22] Filed: Oct. 23, 1978

[30] Foreign Application Priority Data

Oct. 25, 1977 [FR] France ..... 77 32032

[51] Int. Cl.[2] ..... C10G 13/04

[52] U.S. Cl. ..... 208/111; 208/264

[58] Field of Search ..... 208/111, 125, 128, 264

[56] References Cited

U.S. PATENT DOCUMENTS

| | | | |
|---|---|---|---|
| 2,326,553 | 8/1943 | Munday | 208/128 |
| 3,471,398 | 10/1969 | Borst | 208/111 |
| 3,516,925 | 6/1970 | Lawrence et al. | 208/111 |
| 3,876,525 | 4/1975 | Mih et al. | 208/111 |

*Primary Examiner*—Herbert Levine

*Attorney, Agent, or Firm*—Burgess, Ryan and Wayne

[57] ABSTRACT

The invention relates to the catalytic treatment of a gas oil feed stock, distilling between 150° and 530° C., in a reactor zone whose temperature is comprised between 200° and 500° C., the pressure is comprised between 15 and 80 bars and containing a hydrogen form zeolite as catalyst, in the presence of a quantity of isobutane representing from 5 to 100% of said feed stock.

The process is particularly suitable for the improvement of the filtration temperature limit of the gas oils.

7 Claims, No Drawings

CATALYTIC TREATMENT OF GAS OILS

The present invention is directed towards a catalytic process for treating petroleum cuts particularly to improve their flow properties.

The hydrocarbon cuts which can be treated according to the process of the present invention are gas oils, the boiling point of which is comprised between an initial temperature of about 150° C. and a final temperature usually fixed at 450° C. which can, however, reach 530° C. when operating under vacuum.

In this latter case, lubricants can be obtained from these cuts provided there is a preliminary treatment for extracting the aromatic compounds by hydrorefining or solvent extraction. The problem then consists in lowering the flow pour point of the product obtained, without excessively decreasing its viscosity index while assuring a suitable yield for the operation. The lubricant's pour point is defined according to the French Standard AFNOR T 60.105.

In order to be sold the gas oils, must comply with the commercial specification of motor gas oils and domestic fuels. From this point of view, it may be noted that the strictest specifications are the maximum sulfur content and the flow characteristics.

The flow characteristics most often used for gas oils are the pour and cloud point (CP) as defined by the French Standard T 60.105 T and filtration temperature limit usually designated (FTL) as defined by the French Standard AFNOR N 07 042 equivalent to British Standard IP 309 cold filter clogging point (designated CFCP).

In general, the gas oil cuts from straight run distillation, to comply with the specifications must be submitted to various appropriate treatments.

When the sulfur content is too high, generally a desulfurization treatment is effected in the presence of hydrogen. It is then a hydrodesulfurization (HDS) process which makes use of a cobalt-molybdenum type catalyst supported on an alumina matrix.

Until now, two kinds of solutions have been proposed in order to improve the flow characteristics of the petroleum cuts.

The first solution consists in addition of an additive.

The second solution consists in applying a catalytic hydrotreatment called dewaxing.

Certain dewaxing processes use hydrodesulfurization catalysts of the cobalt-molybdenum type on acid supports or matrix. These processes, which consume hydrogen and render possible only weak gas oil yields, are not economically interesting.

Among other dewaxing processes to be mentioned, on the one hand, are those which use platinum based catalysts placed on a halogenous alumina or alumina-silica matrix and on the other hand, those which use zeolite based catalysts which may contain precious metals.

The platinum catalysts placed on an halogenous alumina or alumina silica matrix necessitate operating conditions (temperature, pressure, space velocity) which render the process inconsistent with hydrodesulfurization which in a standard refining flow sheet is usually present.

The zeolite based catalysts have been the subject of numerous patents for about the last ten years. Particularly, French Pat. Nos. 1,496,969 and 2,217,408, Belgium Pat. No. 816,234 and the U.S. Pat. Nos. 3,663,430 and 3,876,525 may be cited.

The zeolites claimed by these patents are mainly mordenite and zeolite ZSM-5, which two products are in an hydrogen form in order to catalyse the isomerisation and hydrocracking of the high melting point hydrocarbons.

In general, it may be observed that the proposed catalysts present a high activity i.e. moderate reaction temperature and high space velocity, but do not offer a sufficient stability for low pressure less than or equal to 30 bars.

The invention is directed to a method for greatly improving the standard catalytic process, enabling an improvement of the cold flow properties of gas oils, in contact with hydrogen, while using the zeolite-based catalysts.

In fact, it was noted, surprisingly, that the addition to the gas oil feed stock entering the reactor, of given quantities of isobutane or butane/isobutane cuts enables both the activity and stability of the catalysts to be improved. This improvement, obtained according to the invention, enables the use of the standard process of treatment of gas oils with catalysts as used in the previous art, but under much more economic conditions.

It may be noted, in fact, that with partial hydrogen pressure as low as 25 bars, i.e. equal to the partial hydrogen pressure currently observed in hydrodesulfurization processes, the service life or span of life of the catalyst is particularly increased.

This last advantage thus becomes very valuable since it enables the perfect integration of the two processes in the same plant: i.e. on the one hand the hydrodesulfurization (HDS) and on the other hand the improvement of the gas oil flow properties.

The invention is thus directed to a catalytic treatment process, in the presence of hydrogen, of a feed stock constituted by a gas oil cut, the distillation range of which is comprised between 150° and 530° C., said process being characterized in that the said feed stock is treated with isobutane continuously injected in the reactor corresponding to a proportion comprised between 5% and 100% by weight of the input weight of the gas oil, in the presence of a hydrogen form zeolite type catalyst.

The zeolites are compounds the detailed description of which may be found in the D. W. BRECK's book "Zeolite Molecular Sieve" J. WILEY and Son. The synthesized zeolites generally contain alkaline ions or alkyl-ammonium as compensation cations. The hydrogen form zeolites are zeolites whose initial compensation cations have been replaced by protons.

The zeolite protonation is realized according to standard techniques such as the treatment by a mineral or organic acid, the ammonium ions exchange being followed by a thermal decomposition, or by oxidizing calcination of the alkylammonium ions when they are present in the zeolite. These techniques are particularly described in D. W. BRECK's book "Zeolite Molecular Sieve", p.569/571 and in "Molecular Sieve", p. 583 by W. M. MIER and J. B. UYTTERHOEVEN Advances in Chemistry 121. ACS. 1973.

Hydrogen form zeolite may also be called cation-free zeolite or zeolite in the protoneous form.

In the process of the invention it is understood by hydrogen form zeolite a zeolite whose rate of exchange of synthesized compensation cations by the protons is equal to or more than 80%.

According to the process of the invention all the known zeolites may be used for an efficient transformation to take place.

The zeolites used in the process of the invention will have $SiO_2/Al_2O_3$ ratios at least equal to 8 and generally comprised between 8 and 100. It was in fact observed that the zeolites with a low alumina content were particularly convenient for this type of process.

It may be noted the zeolites which can be used in the process according to the present invention are among others the modernites (mordenite and mordenite-TEA), the zeolites ZSM-4, ZSM-5, ZSM-11, ZSM-12 and ZSM-21, offretite TMA, etc. which are more generally used under their hydrogen form.

The ZSM zeolites and particularly the ZSM-5 zeolite are described in the Belgium Pat. No. 800,496 and the French Pat. No. 2 217 408. The silica/alumina ratio is comprised between 15 and 100 and is generally close to about 70. Since the product issuing from the synthesis contains tetrapropylammonium and sodium ions it is advisable to replace them by protons in order to obtain the appropriate catalytic activity.

The mordenite is a well known zeolite whose description may be found in D. W. BRECK's book "Zeolite Molecular Sieve", WILEY and SON. The chemical composition in terms of dehydrated cellular unit is $M(8/n)\ [(AlO_2)_8\ (SiO_2)_{40}]$, M being a cation having the valance n.

The mordenite issuing from the synthesis contains as a compensation cation sodium in a content of about 6% by weight: it is thus not acid. It is necessary in order to obtain an acid solid—and therefore catalytically active—toreplace these sodium ions by protons in such a way that the sodium content of the dehydrated mordenite, is lower than 1.2% by weight (rate of exchange 80%). The replacement of sodium by the proton may be conducted by standard techniques such as treatment by a mineral acid or ammonium ion exchange followed by thermal decomposition.

The mordenites thus obtained have a silica/alumina molar ratio equal to about 10. From these mordenites it is possible, through removing the aluminium content by means of a concentrated acid treatment, to obtain mordenites with a silica/alumina ratio capable of reaching 60 and which can be used in the process of the invention, the aluminium removal having no influence on the crystalline structure of the mordenite.

The hydrogen form zeolites used in the process according to the invention may in addition contain, particularly when mordenite is used, an active metal belonging to Group VIII of the Periodic Classification in particular platinum or palladium. The active metal will be introduced in the zeolite according to one of the standard techniques for example through impregnation by means of a salt. The metal content of the zeolite will thus be generally comprised between 0.1 and 1% by weight. The presence of this active metal will generally have the effect of improving the activity and stability of the catalyst.

The process of the invention enables the flow properties of the gas oil cuts to be improved without it being necessary to desulfurize them beforehand. Operating conditions are those generally used in dewaxing processes.

The temperature is comprised between 200° and 500° C. and more usually between 250° and 420° C.

The hourly liquid space velocity or HLSV of the feed stock expressed in $m^3/m^3/h$ is generally comprised between 0.3 and 3.

These two operating conditions are those which are currently used in the processes of the previous art.

The total pressure prevailing in the reactor zone is generally comprised between 15 and 80 bars. It will be advantageously comprised between 25 and 50 bars particularly when the process is operating in combination with a hydrodesulfurization process. The hydrogen/hydrocarbon molar ratio is generally comprised between 2 and 8.

The quantity of isobutane added to the feed stock represents generally between 5 and 100% by weight of that quantity and preferably from 5 to 50%. When isobutane is injected in the form of a butane/isobutane cut only the isobutane fraction must be taken into consideration.

The process itself produces isobutane. At the reactor exit the products obtained may be separated in several fractions by distillation. Certain among these products are recycled at the reactor entry in order to maintain the required ratios between the hydrogen, isobutane and the feed stock. They are essentially light products such as hydrogen, $C_1$, $C_2$, $C_3$, n-$C_4$ eti-$C_4$. Either a drain or a make-up of these products is effected according to whether they are produced or consumed in the reactor.

EXAMPLE 1

This example shows the characteristics of instability of a catalyst of the mordenite type of the previous art in the operating conditions of the invention and the improvement obtained with a catalyst with a finer granulometry; it shows that in these conditions the activity is limited by the diffusion of the reagents. The gas oil feed stock used in this example and in all the following ones, has the following characteristics:

| | | |
|---|---|---|
| Density at 20° C. | | 0.8464 |
| Sulfur % weight | | 1.22 |
| F.T.L °C. | | +1 |
| C.P. °C. | | +4 |
| ASTM distillation | IP °C. | 197 |
| | 5% " | 229 |
| | 50% " | 287 |
| | 95% " | 378 |
| | FP " | 390 |

Operating conditions are:

Temperature: 330° C.
Total pressure: 30 bars
Total LHSV: 1 $m^3/h/m^3$ (liquid hourly space velocity)
$H_2$/hydrocarbon at reactor entry: 4 mole/mole Table I below gives the results obtained with a catalyst obtained by dry impregnating with a platinum salt, an acid mordenite commercially produced by the firm NORTON under the brand Zeolon 900H, and having the properties below.

% Na: 0.3% (rate of exchange about 95%)
$SiO_2/Al_2O_3$: 15.

The platinum salt chosen is an all cases tetrammonium platinum chloride $Pt(NH_3)_4\ Cl_2$, $H_2O$ put beforehand in a volume of solution equal to the retention volume of the solid to be impregnated. The quantity of the salt put in solution is such as to obtain a platinum content in the final catalyst equal to 0.3%.

After the impregnation, the moist catalyst obtained is dried at 100° C. during one hour then calcinated at 520° C. during 4 hours. Before use the catalyst is submitted to a reduction by hydrogen under 7 bars at 540° C. during 16 hours.

Table I shows the values found during the run time regarding the cloud point Δ(C.P.) improvements, measured on the gas oil produced and the feedstock at different operating times:

TABLE I

| Operating time (h) | ΔC.P. (°C.) | Catalyst in granulometry 3 non extruded A | Catalyst in granulometry 1.5 non extruded B |
|---|---|---|---|
| 20 | | 12 | 26 |
| 43 | | 6 | 18 |
| 58 | | 4 | 13 |
| 92 | | 2 | 8 |
| 140 | | 0 | 4 |
| 188 | | 0 | 0 |
| $\alpha(h^{-1})$ | | 0.025 | 0.019 |

During the experiments described in the said table, it was observed that the Δ(C.P.) variation measured in relation with the operating time t may well be a decreasing exponential function similar to those described by WEEKMAN Ind. Eng. Chem. Proc. Res. and Dev. 8 (1969) 385 for other catalyst deactivation processes.

$$\Delta(C.P.)=\Delta(C.P.)_o C^{-\alpha t}$$

The coefficient α is even higher as the catalyst deactivation process is quick.

Table I shows that if the reduction in size of the catalyst grains appreciably increases the catalyst activity, it also enables reduction of the deactivation speed by about 20%.

The same results show also the extreme instability of the catalyst, which is absolutely characteristic of the prior art in the chosen operating conditions, particularly at a pressure of only 30 bars.

EXAMPLE 2

This example is designed to show the large gain of activity and above all stability which is brought about by incorporating isobutane in the gas oil feed stock during the reaction.

Operating conditions and nature of the treated gas oil are the same as in the previous example. The catalyst is that already called catalyst B. In this example a hourly space velocity equal to 1 $m^3$ gas oil/$m^3$ catalyst/hour is maintained and simultaneously with the gas oil feed stock current is introduced a continuous input of pure isobutane corresponding to about 35% by weight of the weight input of gas oil.

The results obtained are those shown on Table II below and must be compared to those shown in the column of Table I corresponding to catalyst B.

TABLE II

| Operating time in hours | Δ(C.P.) °C. |
|---|---|
| 43 | 31 |
| 70 | 21 |
| 117 | 19 |
| 140 | 13 |
| 153 | 9 |
| 183 | 8 |

TABLE II-continued

| Operating time in hours | Δ(C.P.) °C. |
|---|---|
| 207 | 6 |
| 237 | 4 |
| 258 | 2 |
| $\alpha h^{-1}$ | 0.010 |

In this case also the law followed by the drop in activity during operating time is of the exponential type. The value of the deactivation coefficient α may be determined (cf. Table II). The values shown in this table clearly indicate not only the "activator" role of the introduced isobutane but also and above all the fact that this latter decreases by about 50% the deactivation coefficient (0.010 against 0.019 previously).

EXAMPLE 3

This example illustrates the use of catalysts constituted from mordenite associated to various metals in Group VIII. It shows that only platinum and palladium lead to most interesting performances. Operating conditions and the nature of the gas oil are still the same as for Example 1. The impregnation of the metals is always carried out by dry impregnation with a volume equal to the volume of water retention of the solid (mordenite 900H). The solutions used contain the following salts: $PdCl_2$, $RuCl_3$, $RhCl_3$. The results obtained after thirty hours of catalyst cycle are the following:

TABLE III

| Nature of the metal | Content in % weight | Δ(C.P.) °C. measured at 30h of running time of the catalyst* |
|---|---|---|
| Pt | 0.3 | 22 |
| Pd | 0.3 | 15 |
| Ru | 0.3 | 2 |
| Rh | 0.3 | 5 |

*Catalyst obtained from mordenite with a granulometry 1.5 not extruded.

If on the other hand the catalyst containing 0.3% palladium is tested in normal operating conditions while following the Δ(C.P.) variation with time, a deactivation coefficient α equal to $0.018h^{-1}$ is measured; by carrying out the same experiment in the presence of 15% isobutane with respect to the input weight of gas oil, it is possible to restore the value of α to 0.0095.

Thus the beneficial effect of isobutane on the deactivation process of a catalyst constituted by a precious metal placed on commercial mordenite 900H is observed whether such metal is platinum or palladium.

EXAMPLE 4

This is a particularly clear example of the effect of stabilizing the catalyst brought about by the introduction of isobutane in the gas oil feed stock.

The catalyst marked "catalyst B" in Example 1 was subjected to a test of a more industrial type consisting in maintaining between the gas oil at the reactor entry and exit a constant Δ(C.P.) value equal to 6° C. thanks to a progressive adjustment of reactor temperature during its operating time. This test was carried out twice: once with the gas oil previously described in Example 1, another time using the same gas oil with an admixture of about 18% by weight of isobutane. In both cases, operating conditions were the following:

Space velocity: 0.5 $m^3$ gas oil/h/$m^3$ catalyst
Total pressure: 30 bars
$H_2$/hydrocarbon ratio: 4 mole/mole.

The results are shown in Table IV. It may be seen that, without injecting isobutane, it is necessary to increase the reactor temperature by about 2.5° C., every 20 hours, then with a simultaneous gas oil and isobutane injection, it is only necessary to increase the temperature by 2.5° C. about every 40 hours.

It will be noted on the one hand that as foreseen the isobutane not only permits a great improvement in catalyst stability but also improves catalyst activity since the starting temperature of the catalyst with an isobutane make up is 265° C. as against 280° C. without isobutane. Throughout the test, the yields obtained remain approximately constant and equal to those given in Table IV(A) for a temperature lower than 430° C.

TABLE IV

| Hours | Operating Temperature of Reactor (°C.) Feed-stock | Feed-stock + isobutane |
|---|---|---|
| 0 | 280 | 265 |
| 250 | 298 | 274 |
| 500 | 328 | 290 |
| 750 | 357 | 305 |
| 1000 | 387 | 320 |
| 1500 | ~450 | 352 |
| 2000 | — | 383 |

TABLE IV(A)

| | Yields in % weight with respect to the feed-stock |
|---|---|
| $C_1$ | 0.1 |
| $C_2$ | 0.1 |
| $C_3$ | 2.4 |
| $C_4$ | 1.4 |
| $C_5$ | 0.8 |
| cut 80–150 | 1.0 |
| cut 150 | 94.2 |

EXAMPLES 5 and 6

These examples show that the improvement of activity and stability brought about by the isobutane is again present when a mordenite which is not only exchanged but also free of aluminium is used.

The catalyst used is a mordenite 900H which had been leached with hydrochloric acid of 4% by weight in water. Its sodium content is lower than 0.1% by weight and the $SiO_2/Al_2O_3$ ratio is 18. It contains 0.3% platinum.

After hydrogen reduction, the catalyst is tested in the following conditions:

Temperature: 330° C.
Total pressure: 30 bars
HLSV: 2 $m^3$ gas oil/h/$m^3$ catalysts
$H_2$/hydrocarbon ratio: 4 mole/mole.

In Example 5, the gas oil is injected without isobutane; in Example 6, about 39% isobutane with respect to the gas oil is added, the gas oil input remaining identical.

The results are the following:

| Operating time (h) | EXAMPLE 5 gas oil only Δ °C. cloud point | EXAMPLE 6 gas oil + 39% isobutane Δ °C. cloud point |
|---|---|---|
| 20 | 19 | 40 |

-continued

| Operating time (h) | EXAMPLE 5 gas oil only Δ °C. cloud point | EXAMPLE 6 gas oil + 39% isobutane Δ °C. cloud point |
|---|---|---|
| 40 | 21 | 36 |
| 70 | 7 | 27 |
| 90 | 3 | 22 |
| 120 | 1 | 21 |
| 140 | 1 | 20 |
| 160 | 1 | 15 |
| α ($h^{-1}$) | 0.030 | 0.006 |

EXAMPLE 7

This example is designed to show that the present invention is also applicable to the catalytic dewaxing with hydrogen in order to lower the flow point of lubricants to be used for the lubrication of automobile motors, or to obtain oils having a very low flow point such as refrigerating oils, transformer oils, etc.

The feed stock used corresponds to the following characteristics:

Viscosity at 100° F.: 22.0 cSt
Viscosity at 210° F.: 4.3 cSt
VI: 113
Flow point: +32° C.
% waxes: 14% by weight
Sulfur: 730 ppm.

The feed stock was treated at 360° C. and at 30 bars of total pressure, in the presence of hydrogen with an recycling rate of 900 $m^3/m^3$. The space velocity is 3 $m^3$ feed /$m^3$ catalyst/hour. The catalyst prepared by the impregnation method already described is a mordenite containing 0.6% platinum, 0.9 Na and corresponding to a $SiO_2/Al_2O_3$ molar ratio of about 15.

In these conditions, the product obtained having a boiling point higher than 370° C. represents 72% by weight of the feed introduced in the reactor. The boiling point of this fraction 370+ changes from −40° C. to +18° C. in about 12 days; in the case of the presence of isobutane injected with a yield equal to about 15% by weight of the feed stock input, the same variation in the boiling point of the oil obtained is only observed after a much longer time range, of about one month.

What is claimed is:

1. In a process of catalytic treatment in the presence of hydrogen of a feed stock constituted by a gas oil cut of distillation range between 150° and 530° C., the improvement comprising contacting the feed stock mixed with 5 to 100% by weight, based on the weight of said feed stock, of isobutane in a reaction zone at a temperature between 200° and 500° C. and a pressure between 15 and 80 bars with a catalyst comprising a hydrogen form crystalline aluminosilicate zeolite.

2. Process according to claim 1, wherein the hydrogen form zeolite has a silica/alumina ratio between 8 and 100.

3. Process according to claim 1, wherein the zeolite is mordenite.

4. Process according to claim 1, wherein the catalyst is a hydrogen form zeolite associated with a metal of Group VIII of the Periodic Table.

5. Process according to claim 4, wherein the metal is platinum or palladium.

6. Process according to claim 1, wherein the isobutane is used in an amount of 5 to 50% by weight of the feed stock.

7. Process according to claim 1, wherein the temperature in said reaction zone is between 250° and 420° C., the pressure is between 25 and 50 bars, the hourly liquid space velocity is between 0.3 and 3 $m^3/m^3/h$ and the hydrogen/hydrocarbon molar ratio is between 2 and 8.

* * * * *